US006393239B1

(12) United States Patent
Arcaro et al.

(10) Patent No.: US 6,393,239 B1
(45) Date of Patent: May 21, 2002

(54) HIGH CAPACITY TONER CAROUSEL TYPE SHUTTLE COLOR PRINTER WITH AN ALL IN ONE EP CARTRIDGE HAVING RESERVOIR

(75) Inventors: David J. Arcaro, Boise; Wayne E. Foote, Eagle, both of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/695,777

(22) Filed: Oct. 24, 2000

(51) Int. Cl.[7] ..... G03G 15/01
(52) U.S. Cl. ..... 399/227; 399/298; 399/299
(58) Field of Search ..... 399/112, 223, 399/226, 227, 298, 299; 347/115, 116

(56) References Cited

U.S. PATENT DOCUMENTS 5,809,380 A 9/1998 Katakabe et al. ..... 399/227
5,978,642 A 11/1999 Arcaro et al. ..... 399/381
6,201,939 B1 * 3/2001 Yamamoto et al. ..... 399/227 X

FOREIGN PATENT DOCUMENTS

EP 0878742 A1 11/1998

* cited by examiner

*Primary Examiner*—William J. Royer
(74) *Attorney, Agent, or Firm*—James R. McDaniel

(57) ABSTRACT

This invention relates to color printing, and more particularly, to color laser printing systems. Such structures of this type, generally, employ a rotatable, carousel type shuttle color printer with a plurality of toner reservoirs such that one of the plurality of toner reservoirs is a high capacity toner reservoir.

10 Claims, 2 Drawing Sheets

HIGH CAPACITY TONER CAROUSEL TYPE SHUTTLE COLOR PRINTER WITH AN ALL IN ONE EP CARTRIDGE HAVING RESERVOIR

FIELD OF THE INVENTION

This invention relates to color printing, and more particularly, to color laser printing systems. Such structures of this type, generally, employ a rotatable, carousel type shuttle color printer with an all in one electrophotographic (EP) cartridge having a high capacity toner reservoir.

DESCRIPTION OF THE RELATED ART

It is known, in shuttle type color printers to employ a paper drive. Exemplary of such of prior art is commonly assigned U.S. Pat. No. 5,978,642 ('642) to D. J. Arcaro et. al., entitled "Color Printer with Shuttle Type Paper Drive and Method." While the '642 reference utilizes a toner cartridge which includes four separate colors (magenta, yellow, cyan, and black) located along the outside of a single photoconductor drum, these four separate colors each have a separate toner reservoir. Presently, these toner reservoirs contain approximately the same amount of toner. However, it is well known that the black toner is used more frequently for printing, especially for printing text, and this black toner reservoir requires replacement more frequently than the other three colors. Therefore, while the printer of the ('642) reference is capable of color printing, it is desirable to include a black toner reservoir which can hold more black toner.

It is also known, in color image forming apparatus, to employ rotatable image forming units. Exemplary of such prior art is U.S. Pat. No. 5,809,380 ('380) to N. Katakabe et. al., entitled "Color Image Forming Apparatus with Plural Color Units." While the '380 reference utilizes rotatable image forming units and a laser beam which is traversed through the image forming units, the apparatus also does not employ a high capacity black toner cartridge. Also, the '380 reference employs expensive optics located within the rotatable image forming unit. Consequently, a more advantageous color printer would be presented if a high capacity black toner cartridge could be employed, while avoiding the use of expensive optics located within the rotatable image forming unit.

It is apparent from the above that there exists in need in the art for a carousel type shuttle color printer with all in one EP cartridges, which at least equals the printing characteristics of the known color printers, but which at the same time contains a high capacity black toner cartridge and avoids the use of optics in the cartridge. It is a purpose of this invention to fulfill this and other needs in the art in a manner more apparent to the skilled artisan once given the following disclosure.

SUMMARY OF THE INVENTION

Generally speaking, this invention fulfills these needs by providing a carousel type shuttle color printer, comprising an exposure device including a laser beam periodically emitted from the exposure device and a rotatable color image forming unit having a plurality of different color development stations, wherein one of the plurality of development stations includes a high capacity toner reservoir such that the laser beam from the exposure device can be traversed substantially through the high capacity toner reservoir.

In certain preferred embodiments, the high capacity toner reservoir contains approximately twice as much black toner as a conventional black toner reservoir. Also, the carousel type shuttle color printer can print in a simplex or duplex mode. Finally, the printer avoids the use of optics located within the rotatable color image forming unit.

In another further preferred embodiment, the high capacity toner cartridge allows the carousel type shuttle color printer to continue printing longer without having to frequently replace the most frequently used toner color, which is usually the black toner.

The preferred color printer, according to this invention, offers the following advantages: excellent printing characteristics; ease of assembly and repair; good stability; excellent durability; decreased downtime; and good economy. In fact, in many of the preferred embodiments, these factors of printing characteristics, durability, decreased downtime, and economy are optimized to an extent that is considerably higher than heretofore achieved in prior, known color printers.

The above and other features of the present invention, which become more apparent as the description proceeds, are best understood by considering the following detailed description in conjunction with the accompanying drawings wherein like characters represent like parts throughout the views:

DETAILED DESCRIPTION OF THE INVENTION

Figure 1:
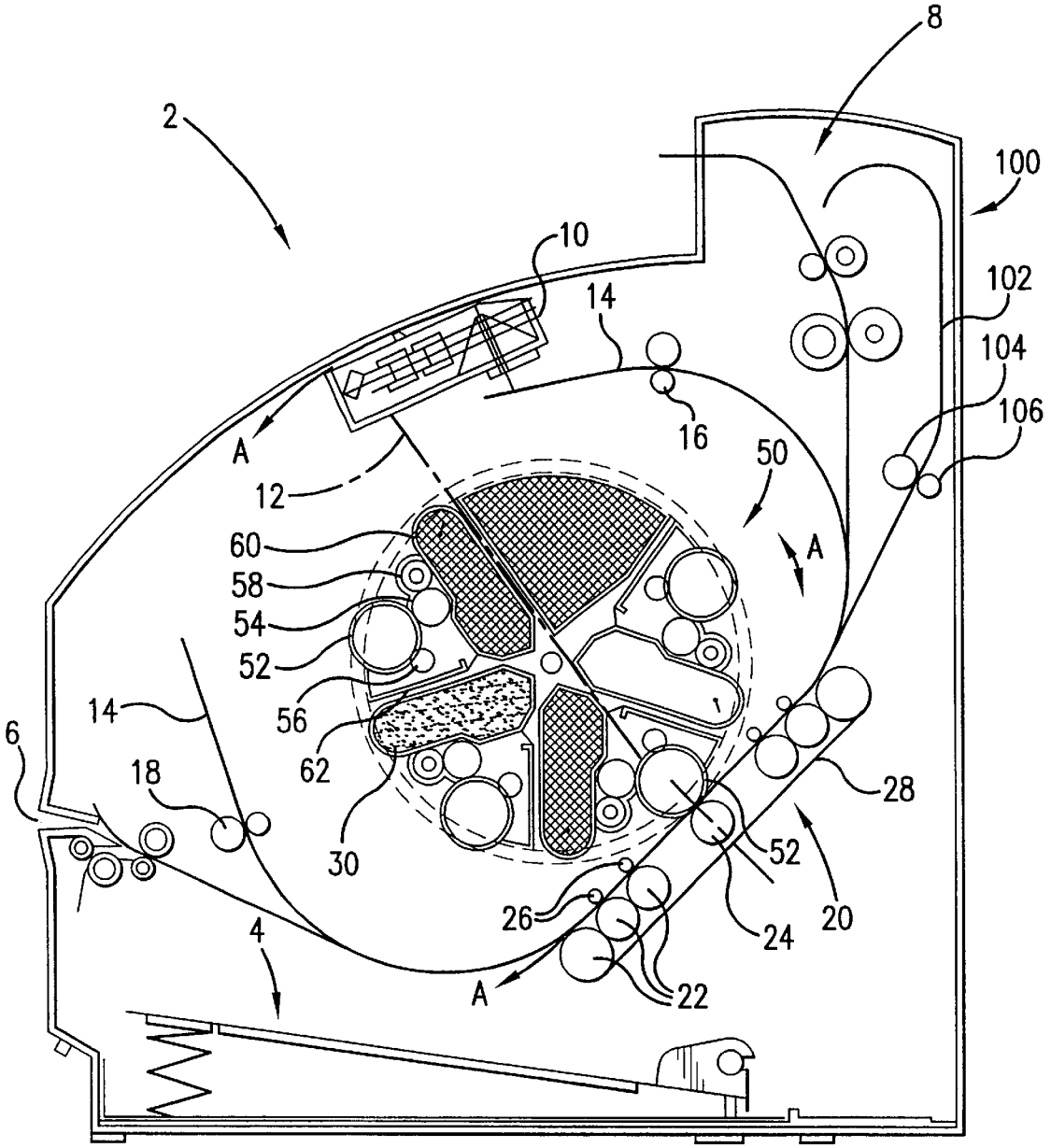
FIG. 1 is a side plan view of a carousel type shuttle color printer with an all in one EP cartridge having a high capacity toner reservoir, according to the present invention.

With reference first to the FIG. 1, there is illustrated in advantageous environment for use of the concepts of this invention. With respect to the FIG. 1, carousel type shuttle color printer 2 is shown. Printer 2 includes, in part, conventional automatic paper infeed mechanism 4, conventional manual paper infeed mechanism 6, conventional paper outfeed mechanism 8, conventional exposure device 10, conventional laser beam 12, paper shuttle path 14, pinch rollers 16, 18, paper transfer mechanism 20, rotatable color image forming unit 50, and duplex mechanism 100.

With respect to paper shuttle path 14, during the shuttling of the paper (not shown), pinch rollers 16, 18 and paper transfer mechanism 20, operate to move the paper back and forth along paper shuttle path 14 by conventional techniques such as set forth in the above referenced '642 patent. Preferably, paper shuttle path 14 is located adjacent to the sides of color image forming unit 50 and is located along the sides of printer 2 by conventional techniques.

With respect to paper transfer mechanism 20, paper transfer mechanism 20 includes, in part, pinch rollers 22, 26, transfer roller 24, and transfer belt 28. It is to be understood that transfer belt 28 contains a grit-like material on its outer side (the side in contact with the paper) in order to more efficiently shuttle the paper.

With respect to color image forming unit 50, color image forming unit 50 includes, in part, photoconductor drum 52, developer roller 54, charge roller 56, foam roller 58, high capacity toner reservoir 60, and waste toner reservoir 62. It is to be understood that while only one of the color development stations of color image forming unit 50 has been described, the other color development stations are constructed in substantially the same manner. In particular, a standard capacity toner reservoir 30 is also illustrated. Preferably, high capacity toner reservoir 60 contains approximately twice as much toner as standard capacity toner reservoir 30. It is to be understood that this standard capacity toner reservoir 30 interacts with its own separate photoconductor drum, developer roller, charge roller, foam roller, and waste toner reservoir.

With respect to duplex mechanism 100, duplex mechanism 100 includes, in part, paper shuttle path 102 and pinch rollers 104 and 106. Paper shuttle path 102 is located adjacent to the sides of color image forming unit 50 in the same manner as paper shuttle path 14. Also, paper shuttle path 102 is similarly located along the sides of printer 2 in the same manner as paper shuttle path 14. Duplex mechanism 100 allows the paper to be printed by conventional techniques on both sides through the use of paper shuttle path 102, pinch rollers 104 and 106, and paper transfer mechanism 20.

Figure 2:
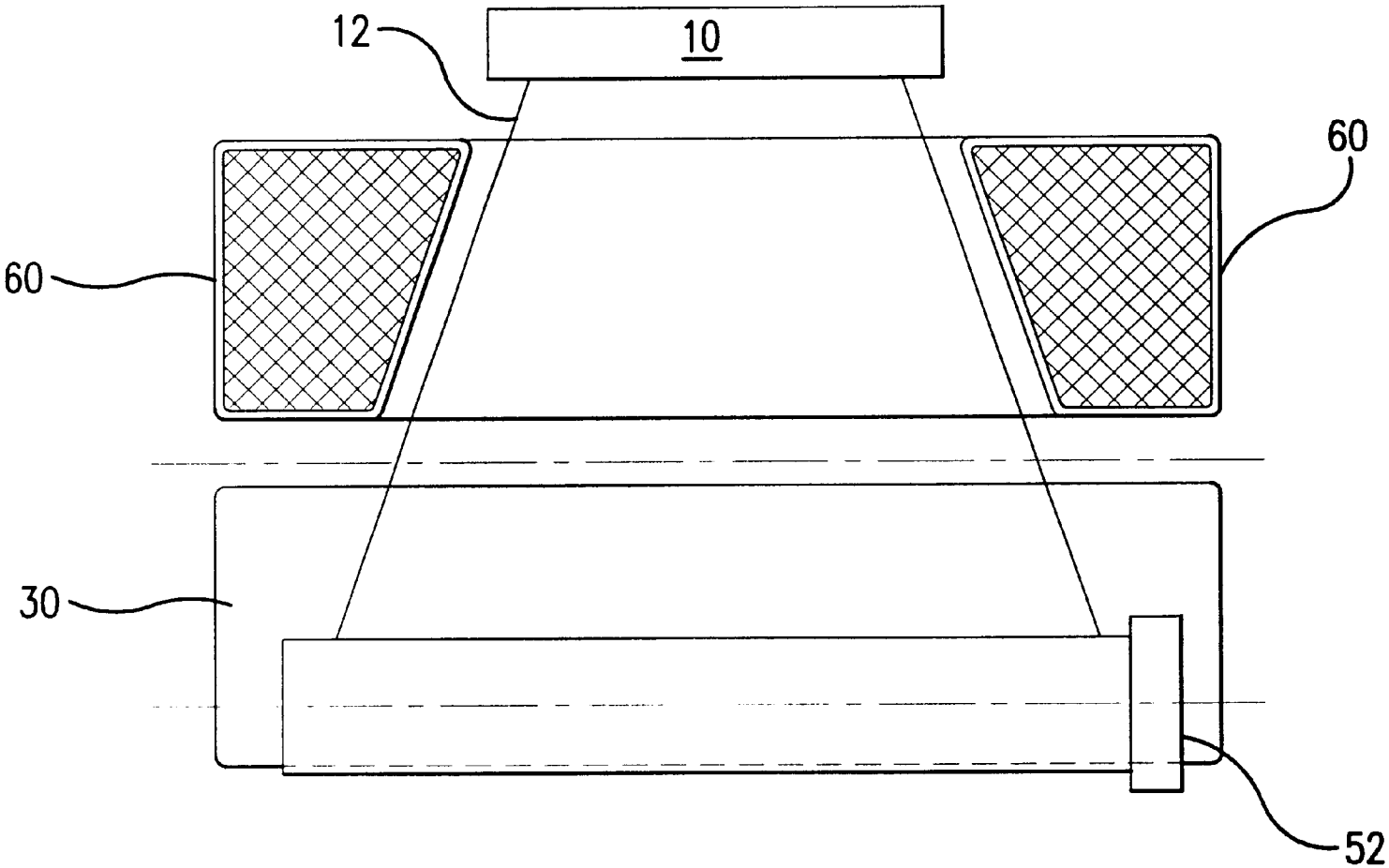
FIG. 2 is a cross-sectional view, taken along line A—A of FIG. 1, of a high capacity toner reservoir, according to the present invention.

As shown in FIG. 2, high capacity toner reservoir 60 is shaped so as to allow laser beam 12 to pass through high capacity toner reservoir 60 and impinge upon photoconductor drum 52. In this manner, a greater amount of toner can be placed in high capacity toner reservoir 60 without adversely affecting the operating characteristics of printer 2.

During the operation of carousel type color shuttle printer 2, paper is transferred from automatic paper infeed mechanism 4 or manual paper infeed mechanism 6 by conventional techniques. At this point, printer 2 selects which color is going to be printed upon the paper. If, for example, black is selected as the color to be printed and black toner is located in the high capacity toner reservoir 60, printer 2 rotates color image forming unit 50 such that the photoconductor drum 52 of the color to be printed is located across from transfer roller 24, as shown in FIG. 1. A laser beam 12 is emitted from exposure device 10 by conventional techniques. Laser beam 12 traverses through high capacity reservoir 60. The image to be printed upon the paper is then transferred to photoconductor drum 52 by conventional techniques. The paper is then printed according to conventional techniques such as those set forth in the above referenced '642 patent. It is to be understood that, if another color is selected to be printed, color image forming unit 50 is rotated, along the directions of arrows A, such that one of the other photoconductor drums is located across from transfer roller 24 and laser beam 12 is traversed along the side of standard capacity toner reservoir 30.

As discussed above, if another color needs to be printed upon the paper, the color image forming unit 50 is rotated along the directions of arrows A by conventional techniques. The paper is then shuttled by pinch rollers 16, 18, paper transfer mechanism 20, and/or duplex mechanism 100. Color image forming unit 50 is then rotated along the directions of arrows A to locate the new desired color, i.e., the photoconductor drum 52 of the new desired color, across from transfer roller 24. After the new color i.e., photoconductor drum 52 is located across from transfer roller 24, the new color is printed on the paper according to conventional techniques. This procedure is implemented until any further desired colors are printed upon the paper.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A carousel-type shuttle color printer, wherein said printer is comprised of:

an exposure device including a laser beam periodically emitted from said exposure device, and;

a rotatable, color image forming unit having a plurality of different color development stations, wherein one of said plurality of different color development stations includes a high capacity toner reservoir such that said laser beam from said exposure device can be traversed substantially through said high capacity toner reservoir.

2. The printer, as in claim 1, wherein said color image forming unit is further comprised of:

a photoconductor drum which is interacted upon by said exposure devise;

a developer roller operatively connected to said photoconductor drum;

a charge roller operatively connected to said photoconductor drum;

a foam roller operatively connected to said developer roller; and a waste toner reservoir operatively connected to said developer roller and said foam roller.

3. The printer, as in claim 1, wherein said printer is further comprised of:

a paper transfer means.

4. The printer, as in claim 3, wherein said paper transfer means is further comprised of:

a transfer roller which contacts said color image forming unit;

a transfer belt means located substantially adjacent to said transfer roller; and a paper shuttle path means located substantially adjacent to said transfer belt means.

5. The printer, as in claim 4, wherein said transfer belt means is further comprised of:

a first plurality of pinch rollers; and a transfer belt operatively connected to said first plurality of pinch rollers.

6. The printer, as in claim 5, wherein said paper shuttle path means is further comprised of:

at least one paper shuttle path; and a second plurality of pinch rollers operatively connected to said at least one paper shuttle path.

7. The printer, as in claim 4, wherein said transfer belt means is further comprised of:

a grit-like material located substantially on one side of said transfer belt means such that said grit-like material substantially contacts an edge of a paper to be printed.

8. The printer, as in claim 1, wherein said high capacity toner reservoir contains approximately twice as much toner as a standard capacity toner reservoir.

9. The printer, as in claim 1, wherein said high capacity toner reservoir contains black toner.

10. A method of color printing using a carousel-type shuttle color printer with an all in one electrophotographic cartridge, wherein said method is comprised of the steps of:

inserting a piece of paper to be printed upon into a rotatable, color image forming unit having a plurality of different color development stations, wherein one of said plurality of different color development stations includes a high capacity toner reservoir;

selecting a desired color to be printed upon said paper such that a toner of said color to be printed is located within said high capacity toner reservoir;

operating an exposure device to periodically emit a laser beam from said exposure device such that said laser beam can be traversed substantially through said high capacity toner reservoir, and;

printing said desired color on said paper.

* * * * *